United States Patent [19]

Nelson

[11] 4,398,238

[45] Aug. 9, 1983

[54] VARIABLE FOCUS FLASHLIGHT

[75] Inventor: Norman C. Nelson, Newberry Springs, Calif.

[73] Assignee: Kel-Lite Industries, Inc., Barstow, Calif.

[21] Appl. No.: 303,418

[22] Filed: Dec. 4, 1981

[51] Int. Cl.[3] ..... F21L 7/00

[52] U.S. Cl. ..... 362/187; 362/202; 362/280; 362/306; 362/319

[58] Field of Search ..... 362/187, 202, 280, 306, 362/319

[56] References Cited

U.S. PATENT DOCUMENTS

| | | | |
|---|---|---|---|
| 2,097,222 | 10/1937 | Tompkins et al. | 362/187 |
| 2,173,650 | 9/1939 | Fullmer | 362/187 |
| 2,273,360 | 2/1942 | Kidder | 362/187 |
| 4,286,311 | 8/1981 | Maglica | 362/187 |

*Primary Examiner*—Stephen J. Lechert, Jr.
*Attorney, Agent, or Firm*—Gene W. Arant

[57] ABSTRACT

A variable focus flashlight has a cylindrical flashlight body and a separate flashlight head which is threadedly secured to the body. A bulb is supported in fixed relation to the body, and a reflector is supported in fixed relation to the head. Rotation of the head changes its longitudinal position relative to the body, hence moving the reflector either forwardly or rearwardly relative to the bulb and thereby adjusting the focus of the flashlight beam.

In order to retain the selected focus adjustment, an expansible spring is disposed partly inside the flashlight body and partly inside the flashlight head, the corresponding ends of the spring being seated in respective ones of those members. The expansive force of the spring biases the interengaging threads of the flashlight head and body, producing a substantial frictional force so as to retain the desired rotational position of the head.

To facilitate desired adjustments, at least one end of the expansible spring is provided with a seat which permits relatively free lateral or rotational movement of the associated spring end.

7 Claims, 4 Drawing Figures

VARIABLE FOCUS FLASHLIGHT

BACKGROUND OF THE INVENTION

It has been well known in the art of flashlight manufacture to provide a focused beam. This has usually been accomplished by using a reflector having a generally parabolic configuration and positioning the bulb or light source at or near the focal point of the reflector.

It has also been well known to provide an adjustable focus for the flashlight beam. The preferred method of accomplishing the adjustment has been to provide a separate head which is secured upon the flashlight body by means of interengaging threads, so that rotation of the head will advance or retract it in a longitudinal direction relative to the flashlight body. The reflector is then fixedly secured to the head while the bulb or light source is fixedly secured to the flashlight body. Thus the bulb can be moved either forward or backward relative to the focal point of the reflector, thereby changing the focus of the beam.

It has also been known in variable focus flashlights to employ a reflector whose configuration does not conform precisely to that of a single parabola, but which is modified to improve the adjustability of the light beam. More specifically, the reflector is designed in such a manner that different incremental portions of the length of its reflecting surface have slightly different focal points.

A significant problem experienced in the prior art has been that, while the flashlight may be adjusted to focus the beam in a desired manner, the adjustment cannot be reliably retained. It is therefore the object and purpose of the present invention to provide a variable focus flashlight which, when adjusted to provide a desired focus of the light beam, will reliably retain that position of adjustment.

DRAWING SUMMARY

PREFERRED EMBODIMENT

Reference is now made to the drawings, FIGS. 1–4, inclusive, illustrating the presently preferred embodiment of the invention.

Figure 1:
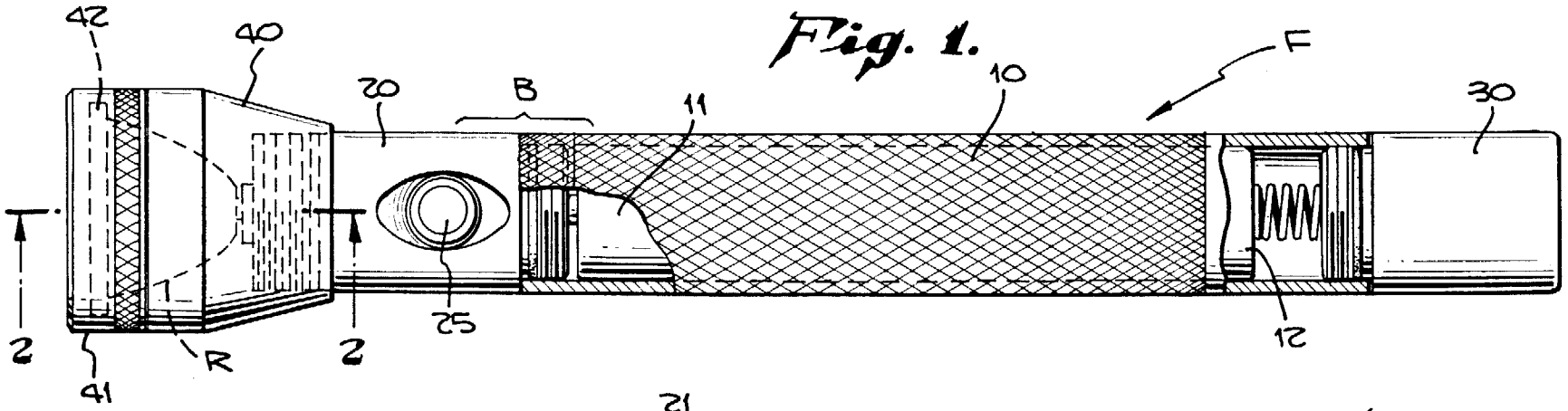
FIG. 1 is a side view, partially in cross-section, of a flashlight in accordance with the presently preferred form of the invention.

As shown in FIG. 1, a flashlight F has a main or battery housing 10 which contains a plurality of batteries such as the batteries 11, 12. Battery housing 10 is of cylindrical configuration, preferably made of a metal such as aluminum, and having a knurled external surface.

Immediately forward of the battery housing is a switch housing 20, also of cylindrical configuration, and preferably machined from aluminum material. Switch housing 20 has the same external diameter as the battery housing 10, and these two housings together constitute the flashlight body B.

It will now be seen that the flashlight F of FIG. 1 is of a modular construction, consisting of several separate units or sub-assemblies that are attached together. Thus an end cap 30 is secured to the rearward end of battery housing 10. End cap 30 preferably contains a recharging circuit of the type disclosed and claimed in my copending application Ser. No. 237,451 filed Feb. 23, 1981, now U.S. Pat. No. 4,357,648.

A head 40 is secured to the forward end of switch housing 20. The head 40 is of significantly greater diameter than the flashlight body B. The forward portion of the head has a cylindrical outer surface while its rearward portion is in the form of a truncated cone, tapering towards the diameter of switch housing 20.

Figure 2:
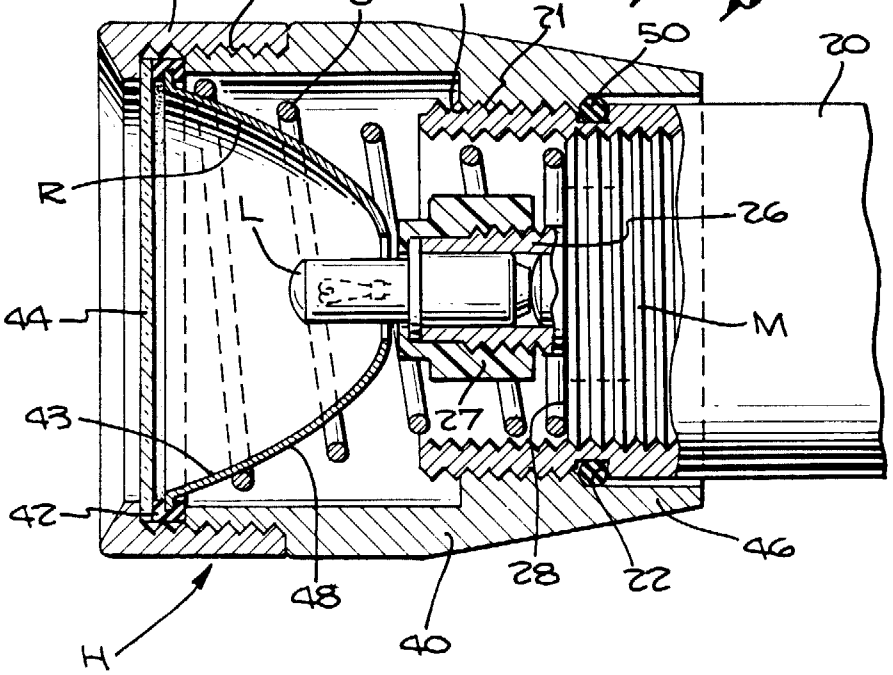
FIG. 2 is a longitudinal cross-sectional view of the flashlight head and adjacent portion of the flashlight body, taken on the line 2—2 of FIG. 1.
Figure 4:
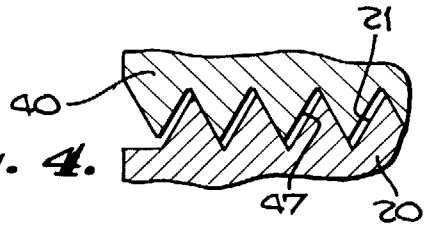
FIG. 4 is an enlarged fragmentary view of the interengaging threads of the head and body, as shown in FIG. 2.

Reference is now made to FIG. 2 illustrating details of interior construction of the flashlight. As shown in FIG. 2, the switch housing 20 has an external thread 21 on its forward end. At the rear of the threaded section 21 there is a seal ring groove 22. The groove 22 is occupied by a seal ring 50.

Inside the switch housing 20 there is a switch module M. A switch button 25, shown only in FIG. 1, is carried by the switch module M and exposed through an opening in the switch housing 20. From the forward end of module M, at its center, a hollow cylindrical bulb receptacle 26 extends in a forwardly direction. A bulb or light source L has its base inserted within the bulb receptacle. The bulb is held in place by means of a bulb clamp 27 that is screwed on external threads carried by the bulb receptable 26.

On its forward end the switch module M also has a flat annular face 28, which serves as a spring seat, as will subsequently be described.

FIG. 2 also shows the internal construction of the head 40. On its forward end the head 40 is of reduced diameter and carries a front threaded section 45. The forward end of the head has a cylindrical interior opening whose diameter is somewhat greater than the external diameter of flashlight body B. At its rearward end, where it has the smallest external diameter, the head 40 has a smooth cylindrical interior surface 46 which acts as a seal wall. The seal wall 46 squeezes the seal ring 50 radially inward towards the groove 22.

Forward of the seal wall 46 the head 40 has its internal surface threaded at 47. This rear thread is of smaller diameter than the seal wall 46, and the threads are interengaged with threads 21 on the switch housing 20.

The complete head assembly II of the flashlight includes, in addition to the head 40, several other parts. A front end ring or face cap 41, also preferably machined from aluminum material, is received on the threads 45 of the forward end of head 40. A reflector base 42 is grasped between the end of head 40 and the end ring 41. Base 42 has a U-shaped cross-sectional configuration, as shown in FIG. 2, and is made of a resilient material. A reflector R is made of metal or other relatively rigid material, and is of a generally parabolic configuration, its forward or wider end having an outwardly turned flange that is received within the interior groove of the reflector base. On the forward side of reflector base 42 is a transparent circular lens 4. Thus, the face cap 41 not only holds the reflector R in place, but also holds the lens 44 in place.

ADJUSTING THE FOCUS

Switch module M has external threads by which it is securely positioned inside the switch housing 20. Thus, the light source L is supported in a fixed position relative to the switch housing as well as the remainder of the flashlight body. Reflector R, on the other hand, has a fixed position within the head assembly H, and hence is supported in a fixed position relative to the head 40. As clearly shown in FIG. 2, reflector R at its apex has an opening through which the forward end of light bulb L projects.

The flashlight head 40 may be rotated as desired relative to the flashlight body 20. The resulting rotation of threads 47 relative to threads 21 will change the longitudinal position of the flashlight head relative to the flashlight body. This movement in turn causes the light source L to move either forwardly or rearwardly relative to the reflector R.

The inner or reflecting surface 43 of reflector R does not conform precisely to the configuration of a single parabola. Instead, successive sections of its length are shaped as sections of different parabolii having different focal points. Thus, as light source L moves longitudinally relative to the reflector, the focus of the light beam remains relatively good, but the beam becomes progressively narrower or progressively wider, depending upon the direction of movement. This method of adjusting the focus has been known in the prior art.

Figure 3:
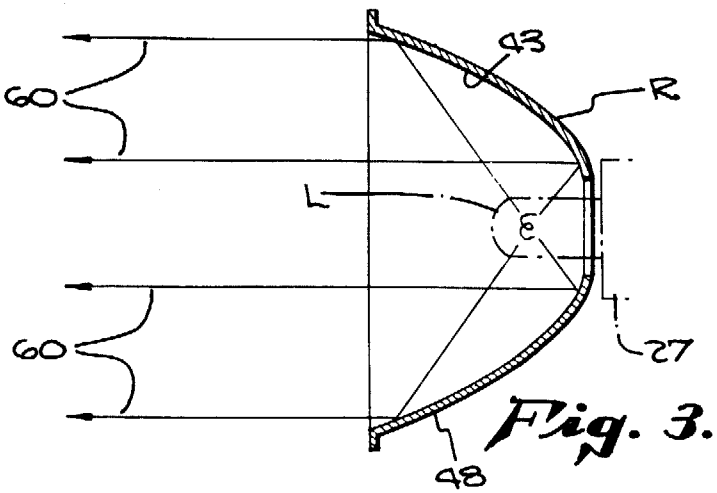
FIG. 3 is a fragmentary cross-sectional view of the bulb and reflector illustrating in schematic form the beam focusing action.

FIG. 3 shows, in schematic form, the operation that is achieved when light source L is at its extreme forward position. The various light rays shown by corresponding arrows 60 then emanate from the reflector R in precisely parallel relationship (or very nearly so) thus producing a very narrow beam of light. It will be understood that when the light source is moved rearwardly, the cooperative action with the reflector is such as to broaden the beam.

RETAINING THE DESIRED FOCUS

In accordance with the present invention an expansible spring S is disposed partly within the flashlight body 20 and partly within the flashlight head 40. Separate seats are provided in the body and in the head for receiving corresponding ends of the spring. Thus, the flat surface 28 on the forward end of switch module M supports one end of the spring. Within the flashlight head, the outer or rearward surface 48 of reflector R provides a seat for the forward end of spring S.

In the presently preferred form of the invention the spring S is of helical configuration, being of smaller diameter on one end than the other. The smaller end of the spring is supported on the flat seat 28 of module M while the larger end of the spring extends around the rearward side of reflector R and engages the rear surface 48 of the reflector.

Spring S has an expansive force and tends to push the flashlight head 40 in a forward direction at all times. This action causes the threads 47 of the head 40 to be at all times biased in a forward direction relative to threads 21 of switch housing 20. This relationship is shown in the fragmentary view of FIG. 4.

The threads 47, 21 are provided with relatively high friction surfaces. Preferably the threads are formed by machining the members 20, 40, which are made of aluminum or other metal. No slick coatings are applied to the threads. Therefore, they have the rather substantial amount of surface friction that is inherent in machined metal surfaces which have not been treated with any kind of smoothing process.

Therefore, the expansive force of spring S, tending at all times to push flashlight head 40 in the forward direction, also loads or biases the threads 47, 21. The substantial frictional force which is thus created between the threads causes the head 40 to retain its desired rotational position.

In order to perform its desired function in a satisfactory manner, the spring S must be seated in such a way that at least one of its ends can move laterally, or rotate, relative to the associated body member. This is most easily accomplished by making the annular surface 28 on switch module M to be a flat and relatively slick surface. At the same time the small end of spring S is formed so that its final turn occupies a single plane. The spring S is then able to rotate rather readily relative to switch module M. Were this not so, spring S might be more effective than desired in retaining the position of the head 40, and could even prevent a desired adjustment of the focus of the flashlight beam from being accomplished. Alternatively, if twisting of the head was accompanied by twisting of the spring S, then the spring would tend to return the head back to its initial position rather than retaining it in the desired position of adjustment. Thus, there is a requirement that at least one of the seat means which receive respective ends of the spring S shall permit relatively free lateral movement of the associated spring end.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

I claim:

1. In a variable focus flashlight having a flashlight body, a bulb supported in fixed relation to the body, a flashlight head, a reflector supported in fixed relation to the head, and interengaging threads supporting the head from the body so that the head may be rotated for adjusting the focus of the flashlight beam, the improvement comprising:

an expansible spring disposed partly within the body and partly within the head;

the body and the head each having separate seat means receiving the corresponding end of said spring, at least one of said seat means permitting relatively free lateral movement of the associated spring end so that the head may be rotated as desired for adjusting the beam focus; and the interengaging threads of the body and head having relatively high friction surfaces, whereby the expansive force of said spring creates a substantial frictional force between said threads so as to retain the desired rotational position of the head.

2. A variable focus flashlight as claimed in claim 1 wherein said expansible spring has a generally helical configuration.

3. A variable focus flashlight as claimed in claim 2 wherein said expansible spring is of smaller diameter on one end than on the other, with the last turn on its smaller diameter end occupying a single plane.

4. A variable focus flashlight as claimed in claim 1 wherein said expansible spring is of generally helical configuration, said expansible spring is disposed substantially concentric to the flashlight bulb, and the forward end of said spring engages the rearward surface of the reflector, the reflector thereby providing one of said seat means.

5. A variable focus flashlight as claimed in claim 4 wherein said seat means located inside said flashlight body has the shape of an annular flat surface, and which further includes bulb receptacle means projecting from the central part of said surface.

6. In a variable focus flashlight, the combination comprising:

a switch housing of generally cylindrical configuration, having an external thread on its forward end, and having a seal ring groove formed at the rearward extremity of said thread;

a switch module disposed within said switch housing in fixed relationship thereto, said switch module having a bulb receptacle projecting forwardly from the transverse center thereof, and also having an annular flat surface on its forward end surrounding said bulb receptacle;

a bulb received within said bulb receptacle, so that its operation may be controlled by said switch module;

a flashlight head which is of larger diameter than said switch housing, the rearward end portion of said flashlight head having an interior cylindrical wall surface which is disposed about said seal ring groove in spaced relationship thereto, said flashlight head also having an interior thread positioned forwardly of said seal wall, said interior thread of said flashlight head engaging said exterior thread of said switch housing;

a seal ring occupying said seal ring groove, said seal wall of said flashlight head acting to radially compress said seal ring;

a reflector of generally parabolic configuration disposed within said flashlight head with the larger end of said reflector being secured to the forward end of said head, said reflector at its rearward extremity having a central opening through which said bulb projects;

whereby said flashlight head may be rotated relative to said switch housing for selecting a desired focus of the flashlight beam; and a longitudinally compressed helical spring disposed partly within said switch housing and partly within said flashlight head, the rearward end of said spring engaging said annular flat surface of said switch module, and the forward end of said spring engaging the exterior and rearward surface of said reflector;

said spring being rather freely rotatable relative to said switch module, and serving to create a substantial frictional force between said interengaged threads so as to retain whatever rotational position of said flashlight head has been selected.

7. A variable focus flashlight comprising, in combination:

a flashlight body of cylindrical configuration, its external surface being threaded at its forward end, and near its forward end containing means providing a flat transverse annular support surface;

means supporting a flashlight bulb extending forward from the center of said annular support surface in fixed relation to said flashlight body;

a flashlight head of generally cylindrical configuration but larger diameter than said flashlight body, the interior surface of said flashlight head near its rearward end being threaded, said flashlight head being supported upon said flashlight body by interengagement of its threads with the external threads of said flashlight body;

a reflector of generally parabolic configuration disposed within said flashlight head, said reflector having an opening at its apex through which said bulb projects into the interior of said reflector;

a lens covering the otherwise open forward end of said reflector;

a face cap removably secured to the forward end of said flashlight head, said face cap normally holding both said lens and the forward circumferential edge of said reflector in fixed relation to said flashlight head;

said flashlight head being rotatable upon the threads of said flashlight body so as to vary the longitudinal position of said reflector relative to said bulb, and hence to adjust the focus of the flashlight beam; and an elongated helical compression spring of tapered configuration, the last turn on the smaller end of said spring occupying a single plane and being pressed against said annular support surface about said bulb, the larger end of said spring surrounding and engaging the rearward outer surface of said reflector;

the interengaging threads of the body and head having relatively high friction surfaces, and the expansive force of said spring thus biasing the threads together in a direction lengthwise of said flashlight body so that the frictional force holding said flashlight head in a selected rotational position is a function of the spring force and the surface friction of the two sets of threads, but is essentially independent of the amount of wear which has occurred in said threads.

* * * * *